United States Patent [19]

Jahnke et al.

[11] 3,985,189

[45] Oct. 12, 1976

[54] DRILL ROD HANDLING DEVICE

[75] Inventors: Robert H. Jahnke, Mequon; David E. Lynch, Greendale, both of Wis.

[73] Assignee: Bucyrus-Erie Company, South Milwaukee, Wis.

[22] Filed: Sept. 19, 1975

[21] Appl. No.: 614,931

[52] U.S. Cl. ..... 175/52; 173/164; 175/85; 214/1 P; 214/2.5

[51] Int. Cl.[2] ..... E21B 19/14

[58] Field of Search ..... 214/2.5, 1 P, DIG. 3; 175/52, 87; 211/60 S; 173/164

[56] References Cited

UNITED STATES PATENTS

| | | | |
|---|---|---|---|
| 3,493,061 | 2/1970 | Gyongyosi | 175/52 |
| 3,913,753 | 10/1975 | Swartz | 214/2.5 |

*Primary Examiner*—Robert J. Spar
*Assistant Examiner*—George F. Abraham
*Attorney, Agent, or Firm*—Quarles & Brady

[57] ABSTRACT

A carousel-type drill rod rack handles a plurality of drill rods having normal diameter holding portions, flats below the holding portions, and reduced necks below the flats. The upper support plate has collars that receive the holding portions and have openings sized to allow removal only when the rods are raised to bring the necks in line with the plate. Cutouts in the upper support plate define two pairs of parallel straight surfaces that engage the flats to limit rotation in either direction but allow limited rotation to provide a breakout impact, and lugs that supportingly engage the shoulders above the flats. A travel lock means includes a rotatable ring with lobes movable into and out of alignment with the shoulders at the bottoms of the necks to prevent forward axial movement when the rack is horizontal and means to lock the ring in normal and lock positions. The lower support plate has sockets for the drill rods and the sockets and lower ends of the rods have indicating holes that enable the operator to determine the rotational and vertical positions of the rods.

20 Claims, 12 Drawing Figures

DRILL ROD HANDLING DEVICE

BACKGROUND OF THE INVENTION

This invention relates particularly, but not necessarily only, to carousel-type drill rod racks for rotary drills such as water well drills and blast hole drills. Such racks are well known in the art — see for example U.S. Pat. No. 2,972,388, issued Feb. 21, 1961 — and generally comprise upper and lower arms that are pivotably mounted and swingable into and out of working position, a vertical center shaft rotatably supported between the outer ends of the arms, upper and lower support plates on the center shaft that receive the upper and lower ends of the drill rods, and means to index the support plates. When a drill rod is to be added to the string, the rack is swung into position to put a rod into alignment with the rotary head, the head is used to make the threaded connection, and the rack is then swung away so that drilling can proceed. For removal, the drill rod section is raised, the rack is swung into position to receive it, the threaded connection is broken, and the rack is then moved back to remove the drill rod.

Such racks are generally quite satisfactory insofar as they provide a convenient and compact means of storing and handling a plurality of drill rods. Known arrangements, however, have a number of disadvantages. For one thing, known arrangements generally include relatively complex latching mechanisms for holding and releasing the upper ends of the drill rods and these are subject to malfunction. Further, known arrangements do not have fully satisfactory means for breaking the threaded connection between the drive head and the top drill rod section without relying only on the torque of the drive head; in some cases, the arrangements require the provision of flats in addition to those usually found at the top of a drill rod. Still further, it is often difficult for the operator, who is standing near the bottom of the mast, to see whether the upper end of the drill rod is properly connected, disconnected, or otherwise oriented with respect to the upper support plate. In addition, such racks are often used with masts that can be titled to a horizontal position for travel, and in this position it is difficult to prevent forward axial movement of the drill rods, for example when the carrier vehicle stops suddenly.

SUMMARY OF THE INVENTION

The general object of this invention is to provide an improved drill rod rack arrangement that is particularly suitable for carousel-type racks but that may very well be useful with other arrangements. One particular feature is an upper support plate arrangement that holds the upper end of a drill rod securely, serves as a wrench for making and breaking threaded connections to the driving head and allows limited free movement to provide breakout impact, and allows for easy removal of the upper end of the drill rod, all without any moving parts and using only the usual top flats of the rod with a simple reduced neck. Another particular object is to provide a highly effective lock means that can be used to lock all of the drill rod sections against axial movement when the rack is in its horizontal travel position. Still another particular object is to provide indicating means on the lower ends of the drill rods and support plate so that the operator can easily detect the vertical and rotational orientation of the rods from his working position.

The foregoing objects are attained with a construction that is highly effective and efficient and mechanically strong, while still being simple and inexpensive to manufacture, assemble, maintain and use. The foregoing and other objects and advantages of the invention will become apparent from the description to follow.

DESCRIPTION OF THE PREFERRED EMBODIMENT

Figure 1:
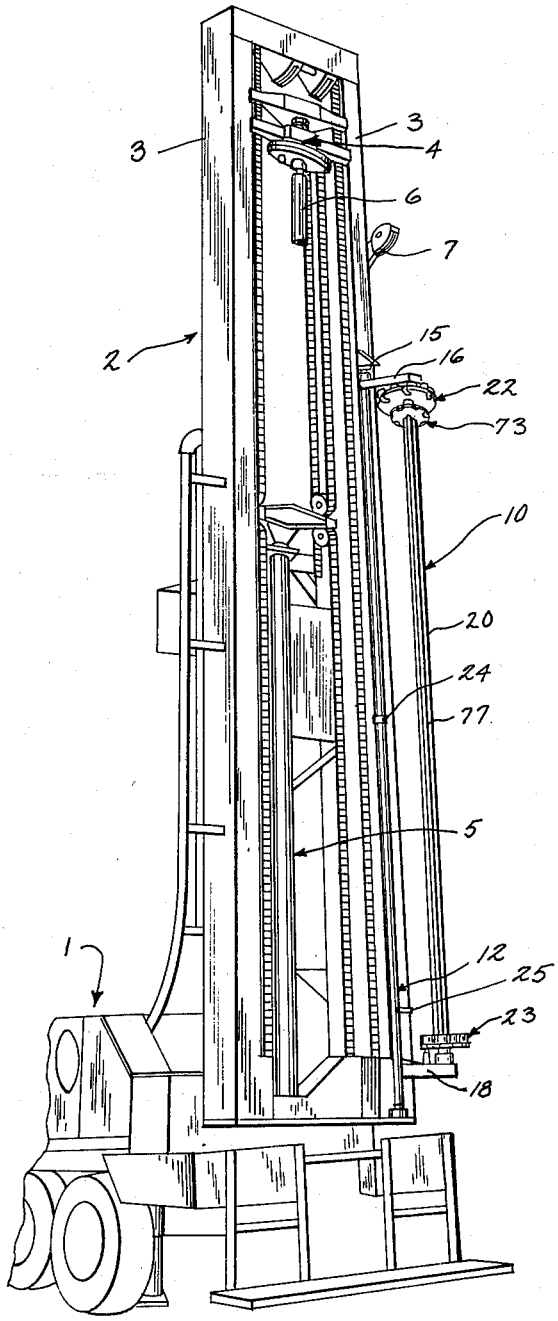
FIG. 1 is a partial schematic view in elevation showing a rotary drilling machine incorporating the invention, the drill rack being shown in a retracted position and empty for the sake of clarity and simplicity.

The rotary drill shown in FIG. 1 is generally conventional and includes a wheeled carrier vehicle 1 at the rear end of which is a mast 2. The mast 2 has opposite side legs 3 and is pivotal from the vertical drilling position shown in FIG. 1 counterclockwise to a horizontal traveling position atop the carrier 1. A rotary driving head 4 is shown near the top of the mast 2 and is movable upwardly and downwardly by means of a chain linkage to a hoist and pull-down cylinder 5. The drive head 4 is rotatable in either direction and is provided at its lower end with a relatively short sub 6 the lower end of which is internally threaded to be connectable to and disconnectable from drill rods as will be described, the drill string extending downwardly from the sub 6 through the deck of the machine at the base of the mast 2 and into the ground. A small jib 7 is mounted near the upper end of the right or rear leg as seen in FIG. 1 and is used with a winch (not shown) for loading and unloading drill rods from the carousel rack to be described. The drill as thus far described is shown only schematically and will not be described in greater detail because such machines are well known to those skilled in the art and because the invention herein is usable with a variety of machines of differing constructions.

The carousel drill rack is designated generally by the reference numeral 10, and it is mounted vertically on the right or rear leg 3 of the mast 2, as seen in FIG. 1, below the jib 7. In FIG. 1, the drill rack 10 is shown empty for the sake of clarity, and in the other views it is shown carrying a single drill rod section designated generally by the reference numeral 11; it will be apparent that the rack in the preferred embodiment is designed to hold six drill rod sections and could easily be modified to hold less or more.

The drill rack 10 comprises a tubular vertical swing shaft 12 having suitable stubs 13 fixed to its upper and lower ends and rotatably journalled in upper and lower bearings 14 that are fixed to upper and lower brackets 15 that are in turn fixed to the mast leg 3. An upper swing arm 16 is fixed to and extends laterally from the upper end of the shaft 12 and is provided at its outer end with a bearing 17. A lower swing arm 18 is also fixed to the shaft 12 near its bottom end to be parallel with the arm 16 and is provided at its outer end with a bearing 19.

A tubular vertical center shaft 20 is provided at its upper and lower ends with stubs 21 that are rotatably journalled in the bearings 17 and 19. A circular upper support plate designated generally by the reference numeral 22 is fixed to the shaft 20 near its upper end, and a circular lower support plate designated generally by the reference numeral 23 is fixed to the shaft 20 near its lower end, the plates 22 and 23 being parallel and in fixed vertical alignment with the shaft 20 extending through their centers, these elements defining the carousel part of the rack.

The swing shaft 12 is preferably provided with an intermediate support band 24 fixed to the mast leg 3 and within which the shaft 12 can freely rotate. An actuating arm 25 is fixed to the shaft 12 near its lower end, and the outer end of the arm 25 is pivotally connected to the outer end of the extensible and retractable rod 26 of a double acting hydraulic actuating cylinder 27, the rear or casing end of which is pinned to a bracket 28 fixed to the mast leg 3 in any suitable fashion. Any suitable source of fluid (not shown) can be used to actuate the cylinder 27.

Figure 2:
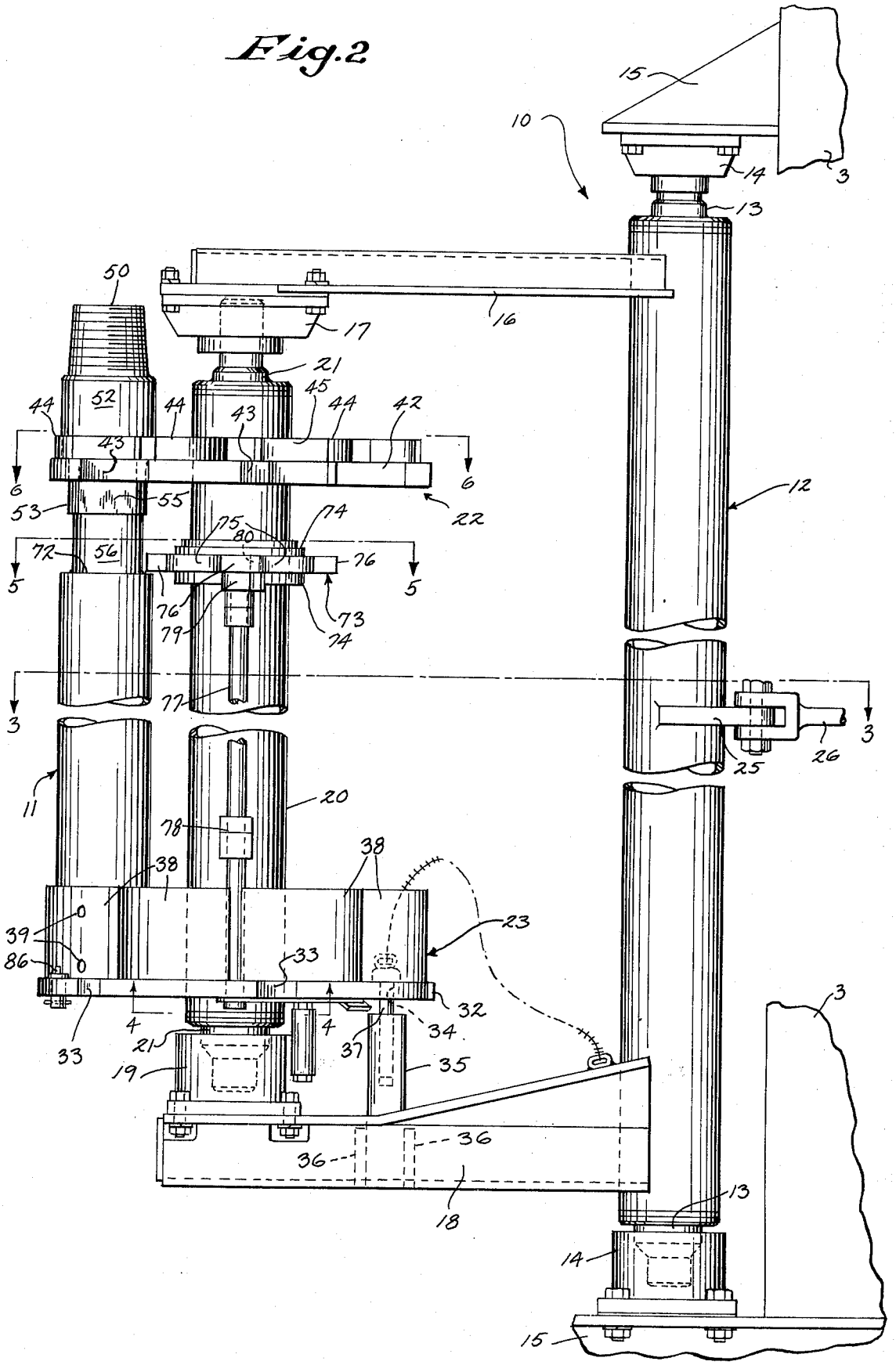
FIG. 2 is an enlarged side elevational view, with parts shown broken away and in cross section, of the drill rack of FIG. 1, one drill rod being shown in place for purposes of illustration.

The shaft 12 defines a vertical axis of rotation about which the entire rack unit 10 can be rotated, this axis being parallel to but spaced from the axis of the drill string leading downwardly form the sub 6, rotation about the shaft 12 resulting from actuation of the cylinder 27. In FIGS. 1 and 2, the rack 10 is shown in a retracted position wherein the arms 16 and 18 extend rearwardly with respect to the machine and the plates 22 and 23 are removed from under the sub 6. It is moved to this position by retraction of the rod 26, and extension of the rod will cause the rack 10 to be pivoted about the shaft 12 to a working position shown in FIG. 3. In working position, the arms 16 and 18 extend substantially crosswise of the machine, and the forward portions of the plates 22 and 23 are located to bring a selected or indexed rod 11 into alignment with the head 4 and the drill string. A stop 29 is preferably provided on the lower arm 18 to engage the mast leg 3 to limit swinging movement toward working position and thus insure proper alignment.

As thus far described, the rack 10 is also generally conventional and it will be apparent to those skilled in the art that other racks could be used with the invention. It is not even necessary that the rack 10 be a swinging rack as shown and the features to be described could be incorporated in racks, arms, or other devices that are moved to and from working positions in line with a rotary driving head and drill string along a horizontal track or in other manners.

Figure 3:
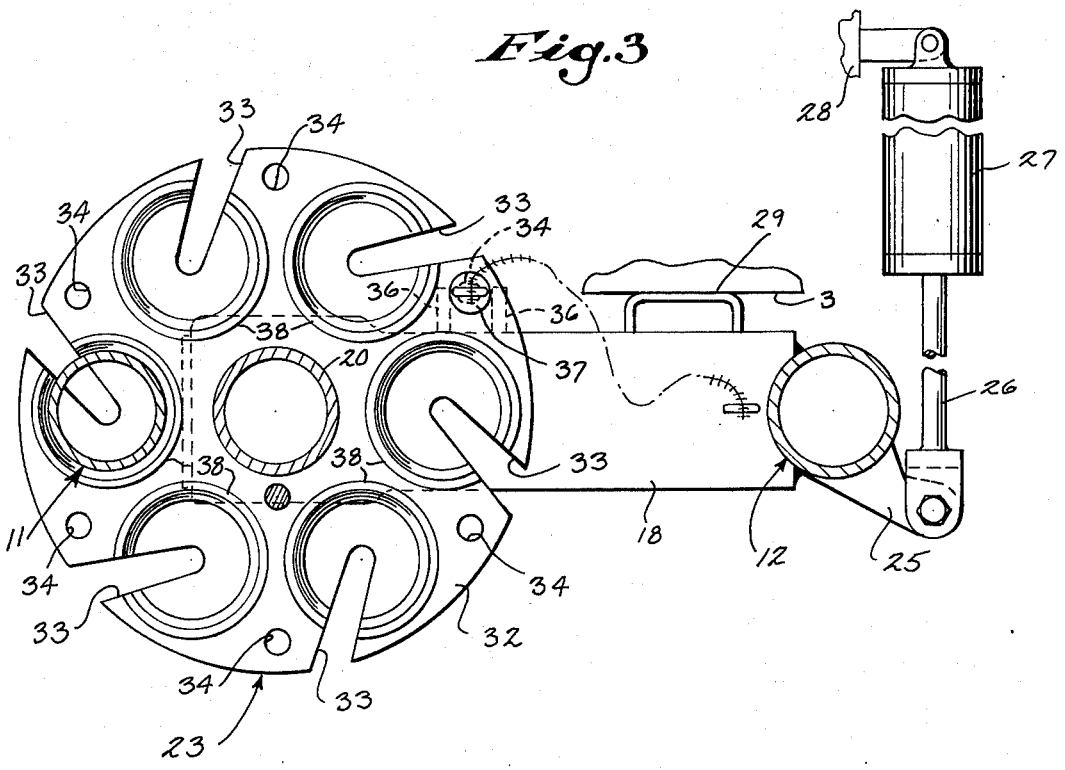
FIG. 3 is a view in cross section through the plane 3—3 shown in FIG. 2, but showing the rack in a working position rather than the retracted position of FIG. 2.
Figure 4:
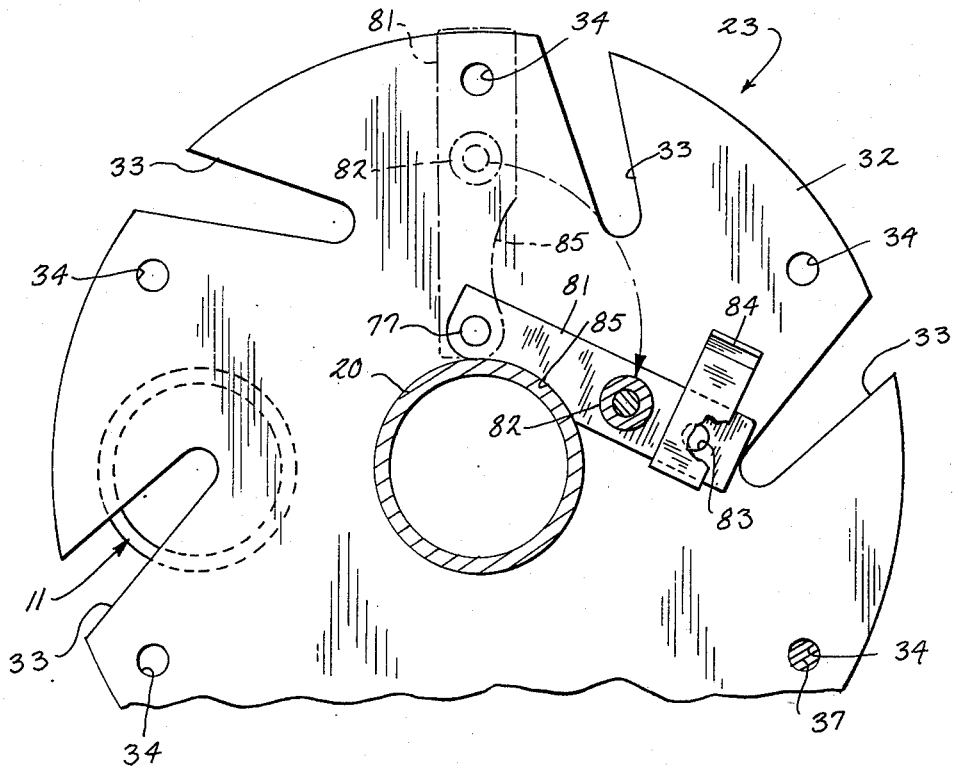
FIG. 4 is a partial view in cross section through the plate 4—4 shown in FIG. 2, with an alternative position of a locking arm shown in broken lines.

The lower support plate 23 is seen most clearly in FIGS. 2–4. It includes a circular base plate portion 32 that is welded or otherwise secured to the shaft 20. Six equally circumferentially spaced, angled, outwardly opening slots 33 are cut into the plate 32; the purpose of the slots 33 is simply to accommodate the C-shaped rod (not shown) that is usually used to support the bottom end of a drill rod as it is being loaded onto or unloaded from the rack 10 when the rack is in its retracted position. Six equally circumferentially spaced indexing holes 34 are also provided in the plate 32, and these serve to locate the plate 23, and therefore the entire carousel since the plate 22 is fixed to the shaft 20, in any of six equally spaced indexed positions in each of which a rod 11, or an opening therefor, is in alignment with the head 4, sub 6 and drill string. As can be seen most clearly in FIG. 2, a tubular, vertically oriented sleeve 35 is fixed to the lower swing arm 18 between mounting ears 36, and the sleeve 35 is located such that it can be in alignment with any of the holes 34 as the plate 23 rotates. A headed indexing pin 37, preferably provided with a retainer chain, is adapted to be inserted through any of the holes 34 into the sleeve 35 to lock the rack 10 in any of its indexed positions, and is removed and reinserted when it is desired to change position.

Figure 7:
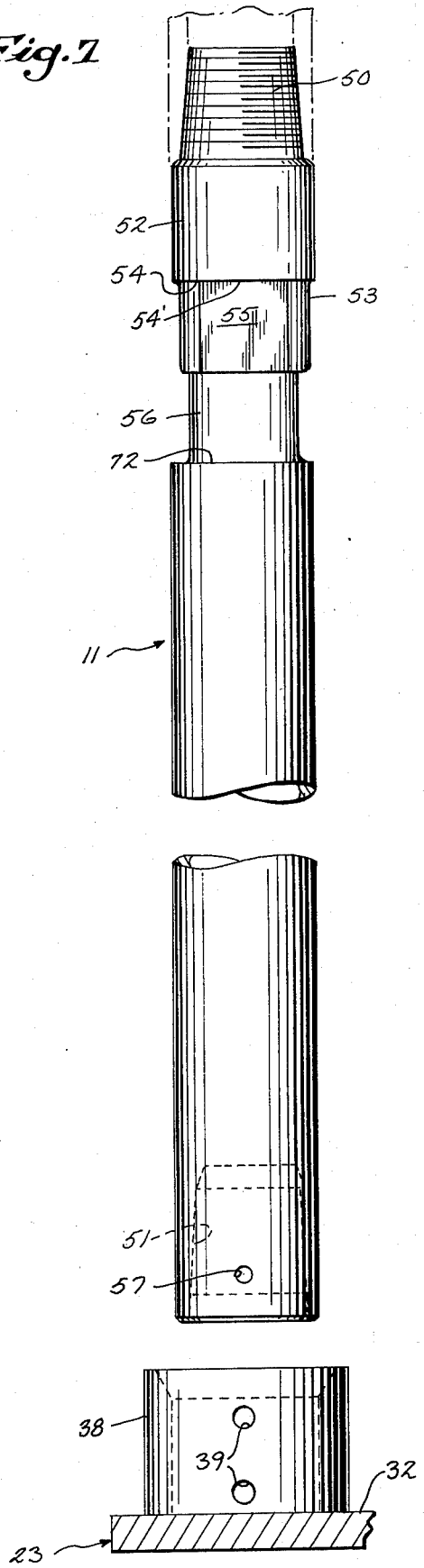
FIG. 7 is a side elevational view, partially broken away, showing a drill rod and a lower receiving socket, and illustrating the indicator means.

Fixed to the upper surface of the plate 32 are six equally circumferentially spaced cylindrical sockets 38 having internal diameters sufficient to receive the lower end of a drill rod section 11 with a relatively loose fit. The walls of the sockets 38 are interrupted to conform to the slots 33, and each socket has its axis in vertical alignment with the inner end of a respective slot. As can be seen in FIG. 7, each socket is provided with a pair of vertically spaced and aligned indicating holes 39 the purpose of which will be described below.

Figure 6:
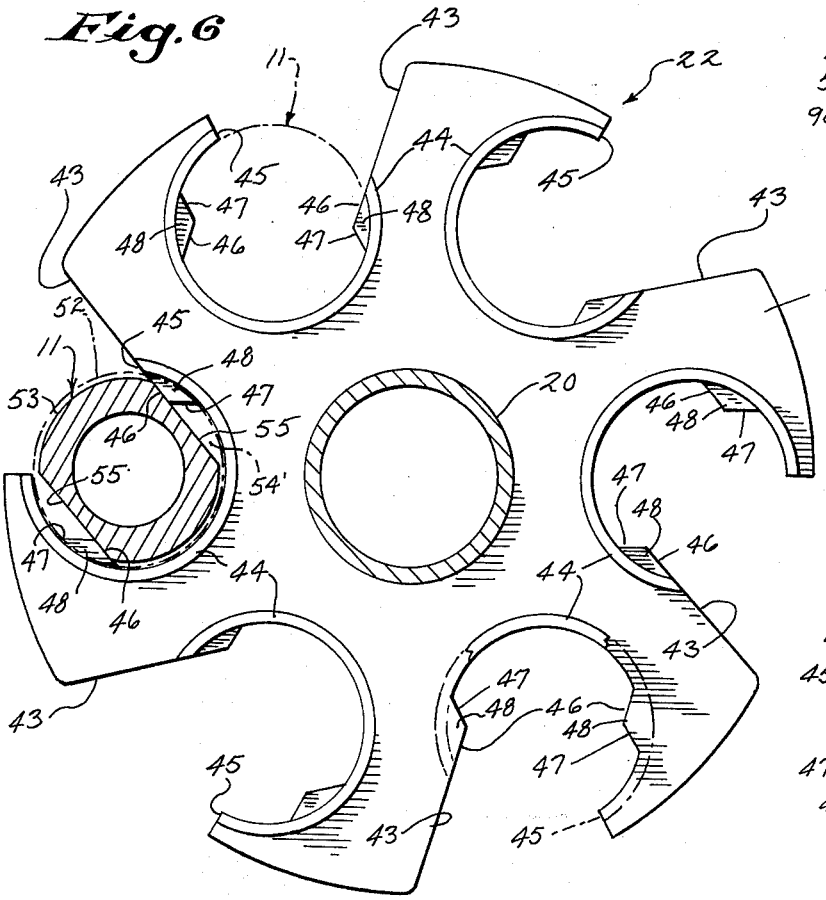
FIG. 6 is a view in cross section through the plate 6—6 shown in FIG. 2.

The top support plate 22 is best seen in FIGS. 2 and 6. It also comprises a generally circular base plate portion 42, and is provided with six equally circumferentially spaced, irregularly shaped cutouts 43 that will be described in more detail below. Fixed to the upper surface of the plate 42 are six circumferentially interrupted circular collars 44 that have substantially the same internal diameters as the sockets 38, each collar 44 being fixedly vertically aligned with a corresponding socket 38 and a corresponding cutout 43. The interruptions in the collars 44 define generally radially outwardly facing throats 45, the width of which is substantially less than the inner diameters of the collars 44.

The radially innermost portions of the cutouts 43 are generally circular and conform to the inner diameters of the sleeves 44. They are, however, shaped to define a first set of parallel, straight side surfaces 46, spaced apart a distance approximately equal to that between the rod flats to be described, and a second set of spaced, parallel straight side surfaces 47 that are at an angle to and intersect the surfaces 46, the lateral spacing between the surfaces 46 being substantially the same as that between the surface 47. The intersecting sets of surfaces 47 and 46 define a pair of diametrically opposite, generally triangular lugs or ledges 48 that extend into the area circumscribed by the collar 44.

The radially outer portion of each cutout 43 defines an opening in alignment with the associated throat 45 and of essentially the same size. Referring to the opening shown in the lower right corner of FIG. 6, where a portion of the collar 44 is cut away, it will be seen that the right portion is cut on a radial line with respect to the plate 42. The left portion is a continuation of the surface 46, but this is not necessary and it may be desirable to cut away some of the material lying radially outwardly of the corresponding end of the collar 45 to prevent interference in loading and unloading as will be described.

Figure 8:
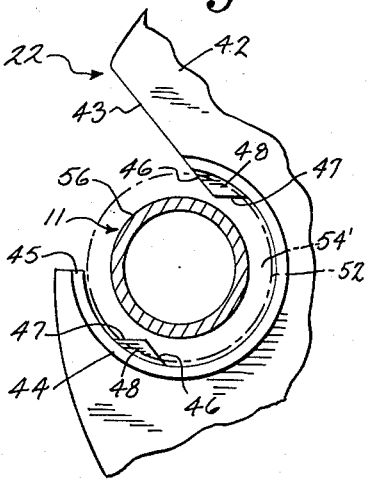
FIG. 8 is a fragmentary view similar to FIG. 6 but showing the drill rod in another axial position.

The drill rods 11 to be put in the rack 10 are all the same, and so only one has been shown. Each rod is tubular and cylindrical and has a relatively constant outside diameter. At the top of each rod 11 is an externally threaded, tapered tip 50 that is adapted to be threadedly received in and removed from the sub 6 or the box of another drill rod above it. At the bottom end of each rod 11 there is an internally threaded box 51 adapted to receive the tip 50 of the rod below. Immediately below the tip 50 is a holding portion 52 of a normal diameter equal to the diameter of the major portion of the rod 11. Immediately below the portion 52 is a flatted portion 53 of somewhat reduced diameter to define a downwardly facing annular rim 54, and the sections 53 are shaped to define diametrically opposite, parallel, axially extending and aligned flats 55 seen in cross section in FIGS. 6 and 9, the distance between the flats 55 being only slightly less that that between the members of the sets of surfaces 46 and 47. While the rim 54 extends entirely around the section 53, it is much wider over the flats 55 and these portions constitute horizontal shoulders 54' that overhang the flats. Immediately below the section 53 is a neck 56 of further reduced diameter that is seen in cross section in FIG. 8. Near the bottom of the rod 11 are a pair of diametrically opposite indicating means in the form of holes 57, only one of which can be seen in FIG. 7, each hole 57 being in vertical alignment with the vertical center line of the associated flat 55. It should be noted that flats and shoulders like those shown herein are normally found on drill rods for engagement by lower breakout means like those to be described, but it is a particular feature of this invention that they are also used in cooperation with the upper plate 22.

In use, and at the beginning of a drilling operation, the rack 10 will normally be filled with six rods 11, with the top of each rod suspended on the plate 22 by virtue of the fact that the overhanging shoulders 54' are supportingly engaged by the lugs 48, and the bottom disposed within a corresponding socket 38. As can be seen in FIGS. 2 and 6, the lower end of the portion 52 of each rod will be received within a collar 44 with a relatively loose fit, the diameter of the portion 52 being greater than the width of the throat 45 so that the top of the rod cannot be moved radially outwardly. The flatted portion 53 will be at the level of the cutouts 43; the rotational position about the axis of the section 11 might be anywhere between the position shown in FIG. 6 and that shown in FIG. 9, but whatever the position the section 52 will prevent removal. Also whatever the rotational position, the shoulders 54' will be resting on the lugs 48 to suspend the section from the plate 22. The neck section 56 will be below the plate 42. The bottom of the section 11 will be in the associated socket 38, but preferably suspended about half an inch above the base plate 32. The pin 37 will be in place so that the plates 22 and 23 are held in one of their six selected positions.

Figure 10:
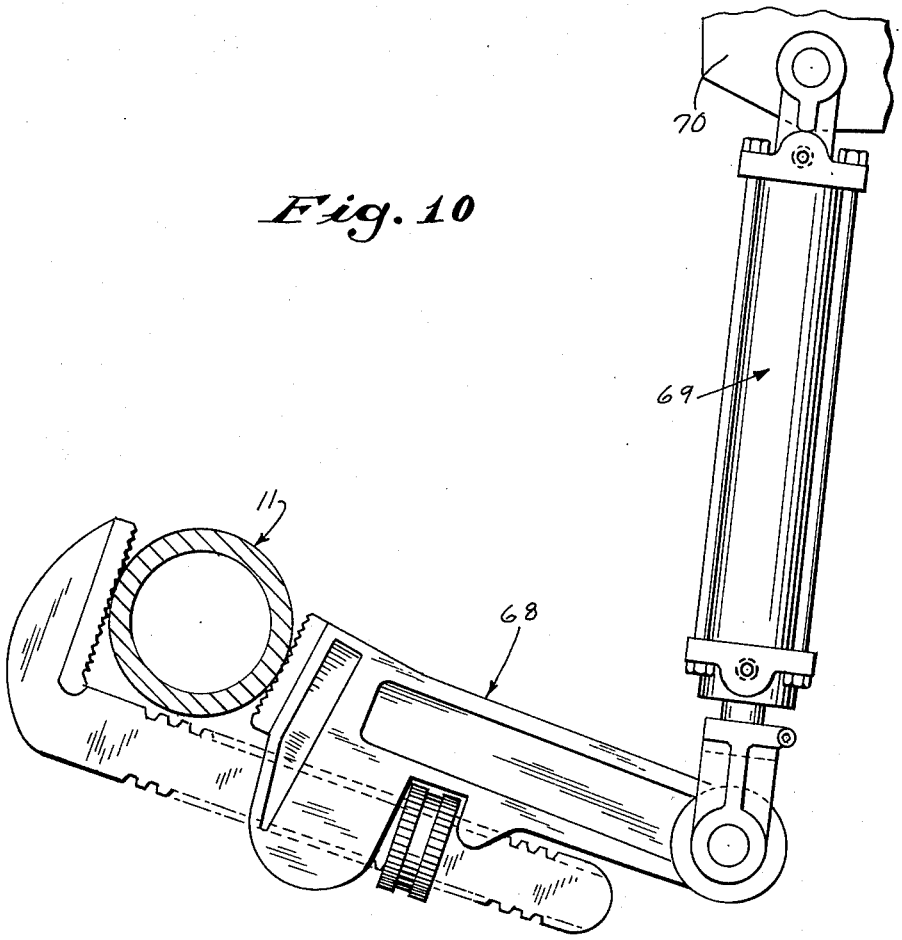
FIG 10 is a schematic illustration of a breakout wrench for the machine of FIG. 1.
Figure 11:
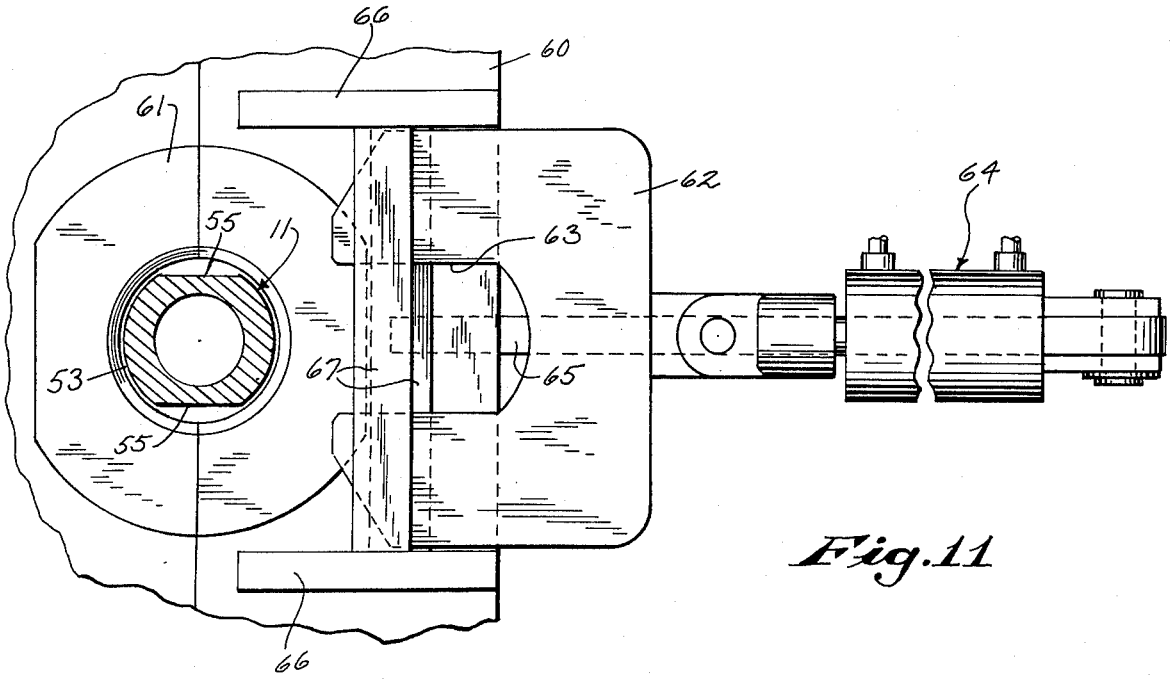
FIG. 11 is a schematic illustration of a holding wrench for the machine of FIG. 1.

There is a conventional breakout mechanism on the breakout table near the bottom of the mast 2, and the mechanism used in the preferred embodiment is illustrated quite schematically in FIGS. 10 and 11. In FIG. 11, the reference numeral 60 indicates the horizontal breakout table through which the drill string extends and there is a conventional guide bushing 61, the table and bushing both preferably being of split construction. A holding wrench 62 has a straight sided jaw sized to grip the flats 55 and is moved inwardly and outwardly with respect to the drill string by means of a double-acting hydraulic cylinder 64 mounted on an elongated bracket 65 that is fixed to and extends outwardly from the breakout table 60. The wrench 62 is guided in its movement by opposite side rails 66 fixed to the table 60 and vertically spaced, horizontally offset upper and lower guide bars 67 connected to and extending between the rails 66. The breakout wrench means is shown in FIG. 10 and is disposed at any suitable location above the holding wrench 62. It includes a wrench member 68 in the form of a large adjustable pipe wrench that is actuated by a double-acting hydraulic cylinder 69 pinned to a bracket 70 that is fixed to the mast or some other suitable support. When it is desired to break the connection between two rods 11, the wrench 62 is first slid into place to engage the flat surfaces 55 of the lower rod, and the cylinder 69 is extended to move the wrench 68 in a clockwise direction as seen in FIG. 10 after which it is put into position engaging the upper rod 11 and the cylinder 69 is retracted to cause the upper section to turn counterclockwise and thus break the threaded connection. The lower rod 11 remains suspended because the shoulder 54' will be resting on the top of the wrench 62. While the breakout arrangement shown is satisfactory, many well known mechanisms might be used; further disclosure of breakout mechanisms is found in U.S Pat. Nos. 3,844,547 Oct. 29, 1974) and 3,832,918 Sept. 3, 1974). It is, however, important to note that almost all breakout mechanisms utilize flat surfaces on the upper end of each drill rod with an overhanging shoulder, and this invention allows the same configuration to be used for holding the rods in the upper support plate 22.

Figure 9:
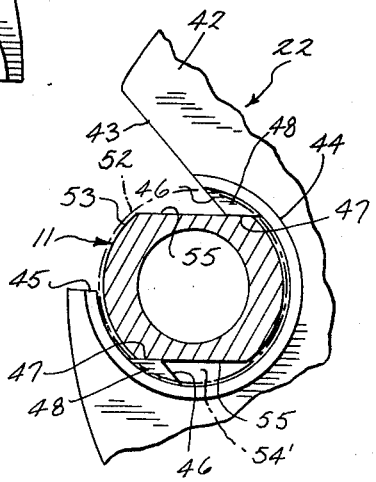
FIG. 9 is a fragmentary view similar to FIG. 6 but showing the drill rod in a different rotational position.

Assuming that drilling has not yet started and the first rod 11 is to be put in place, the head 4 and sub 6 will be in upper positions above the rack 10 and the cylinder 27 will be actuated to pivot or swing the rack 10 to the actuated position shown in FIG. 3, in which one of the rods 11 (not that shown in FIG. 3) will be in direct vertical alignment with the head 4 and sub 6. The head 4 will then be lowered and rotated to screw the sub 6 onto the tip 50 of the corresponding rod 11. This will cause the rod 11 to be rotated in a clockwise direction as seen in FIGS. 6 and 9, and assuming it starts in a position somewhere between that in FIG. 9 and FIG. 6 it will rotate to the position of FIG. 6 where the flats 55 are against the parallel surfaces 46 and this engagement causes the plate 42 to act as a holding wrench preventing further rotation until the sub 6 is threaded completely onto the tip 50. After threading is completed, the head 4 will be raised to bring the rod 11 to the level illustrated in FIGS. 7 and 8. In this position, the neck 56 is at the level of the plate 22 and vertically spans the collars 44 and cutouts 43, the axial length of the portion 56 preferably being about two inches greater than the distance between the top of the collar and the bottom of the plate to allow some leeway, and the bottom end of the rod 11 will be above its socket 38 as seen in FIG. 7. In this position, the cylinder 27 can be retracted to move the rack 10 back to the position of FIG. 1, which will leave the drill rod 11 suspended on the sub 6. The first rod 11 will of course be fitted at its bottom end with a suitable bit for drilling, and the head 4 will be rotated and lowered to drive the rod 11 into the ground.

During the time the first drill rod 11 is being rotated into the ground, the operator will remove the pin 37 and manually rotate the carousel about shaft 20 approximately 60° to bring the next rod 11 into position for insertion, at which time the pin 37 will be reinserted into the next index hole 34. It is also possible during this time to load or unload rods 11, using the jib 7 and a suitable winch and cable arrangement (not shown).

When the first rod 11 has been turned into the ground, the head 4 will have moved downwardly until it is near the bottom of the mast 2. At this point, drilling is stopped and the breakout mechanism is used to break the connection between the sub 6 and the rod 11, the wrench 62 serving to support the rod 11 that is in the ground as indicated above. The head 4 is then raised again toward the position in FIG. 1 and as soon as it is high enough the rack 10 can be swung back inwardly to its working position. The succeeding rod 11 will be picked up in the manner previously described and then lowered until its box 51 is in position to be threaded onto the tip 50 of the first rod, using the driving head 4 to effect the necessary rotation. This sequence of operations is continued until the hole has reached the desired depth.

When the drill string is to be removed, essentially the reverse of the foregoing procedure is followed. The head 4 is raised until the uppermost rod 11 is above the ground and the flats 55 of the next lower rod are in a position to be engaged by the wrench 62. The wrench 62 is then moved into place and the wrench 68 is used to break the connection between the first two rods; using the lower breakout wrench 68 is important since attempting to disconnect by reversing the head 4 might break the joint at the sub 6 rather than the one at the breakout table. The wrench 62 is important after the first connection is broken since it positively supports the remaining portion of the drill string in the ground.

The head 4 is then raised to lift the uppermost rod 11, which is still connected to the sub 6, to a position where the neck 56 is at the level of the plate 42 and collar 44. The rack 10 will have been indexed so that an empty socket 38 and cutout 43 will be in position for use, and it will be swung back toward actuated position and the rod 11 will then be loaded onto it. Loading is, however, a difficult operation since the operator is not really in a position to see the level and rotational orientation of the upper end of the rod 11 being disconnected, and it is in removal that the holes 39 and 57 become very important. The operator, who is standing at the bottom of the mast, can determine the vertical position of the neck 56 by the spacing between the top of the socket 38 and the bottom of the drill section 11; in the preferred embodiment, a spacing of about one and one-half inches indicates that the axial center of the neck is in alignment with the plate 22, and as previously indicated the neck has sufficient axial length so that there can be some variation is spacing. Once the neck 56 is in proper vertical position, the rack 10 can be swung fully inwardly to working position. After that, it is necessary to lower the head 4 to bring the flats 55 to the level of the surfaces 46 and 47. It is, however, difficult for the operator to determine from the base of the mast whether the rod 11 is in proper rotational position and the holes 57 and 39 are used for this purpose. As previously indicated, the holes 57 are in vertical alignment with the flats 55. The holes 39 are in vertical alignment with one of the surfaces 46, and so the operator can use head 4 rotate the drill rod 11 until the hole 57 is in vertical alignment with the holes 39 and the flats 55 will then be aligned with the surfaces 46. At this point the operator can lower the head 4 and rod 11, but they cannot be lowered completely since unscrewing the sub 6 from the tip 50 will result in axial displacement and if the rod 11 were against plate 22 and held against downward movement this would result in upward force against head 4, which could cause damage. Accordingly, the operator will lower the head 4 and rod 11 only until the bottom ends of the flats 55 are against the surfaces 46. The upper hole 39 is set at a level where the lower end of the rod 11 will be visible through it when this position is reached, and the operator is thus able to easily determine that the rod 11 is in proper position.

The operator will then rotate the head 4 counterclockwise to break the connection between the sub 6 and rod 11, and it is at the beginning of this action that the presence and location of the surfaces 47 become very important. When the rod 11 is first brought into the plate 22, the flat surfaces will be in the position shown at the left side of FIG. 6, because the rod is lowered with the holes 57 and 39 in vertical alignment. Counterclockwise rotation of the sub 6 will, however, cause the rod 11 to rotate counterclockwise to the position of FIG.. 9 where the flats 55 are against the surfaces 47 and the cutout 43 again serves as a wrench holding the rod 11 against further rotation and allowing rotation of the sub 6 to continue and unscrew the threaded connection. The rod 11 rotates approximately 45° between the position of FIG. 6 and that of FIG. 9, and this is extremely important in that it provides for a running start terminating in an impact against the surfaces 47 which provides initial breaking of the threaded joint. It might be possible to do this simply by rotating the head 4, but the head may not be able to develop the necessary torque for initial breaking of the connection and the impact provided by the noted spacing is extremely advantageous.

As unthreading progresses, the rod 11 will move downwardly, and the axial length of the flats 55 is sufficient so that they will remain in engagement with the surfaces 47 during the entire unthreading action. Again, however, it is difficult for the operator to determine when the threaded connection has been completely broken and so the vertical position of the lower hole 39 is selected so that the bottom edge of the rod 11 will be visible through the lower hole when the unthreading has been completed. When the connection is broken, the rod 11 will be suspended by the upper plate and above the floor of the socket 38 as previously indicated, and the rack 10 will be swung back toward retracted position. The head 4 will then be lowered to pick up the next rod 11, and the noted procedure is repeated until all of the drill rods have been removed.

Figure 5:
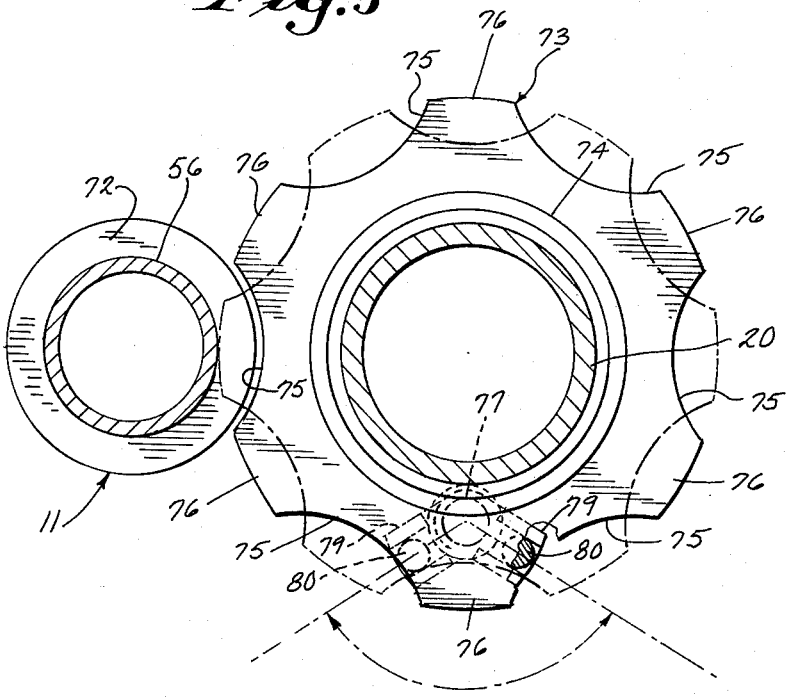
FIG. 5 is a view in cross section through the plane 5—5 shown in FIG. 2, partially broken away and showing an alternative position of a lock ring in broken lines.

When the drill is moved from site to site, the mast 2 is pivoted counterclockwise or forwardly as seen in FIG. 1 to a horizontal position (not shown). Assuming the drill rack 10 is loaded, the rods 11 will also be horizontal and they may tend to move axially forwardly or rearwardly as the vehicle moves, particularly in the event of sudden stops or starts. Rearward movement is prevented by engagement of the shoulders 54 with the ledges 48, but there is nothing positive to prevent forward movement. Accordingly, the invention also contemplates a novel locking arrangement which utilizes the annular shoulders 72 at the bottom of the neck 56 as seen in FIG. 7, these shoulders facing forwardly when the mast is tipped to horizontal position. A generally circular locking ring 73 is disposed on the shaft 20 so that, as seen in FIG. 2, its bottom surface is slightly above the shoulders 72 when the drill rods 11 are in stored position, which would put it slightly forward of the shoulders when the rack 10 is horizontal. Upper and lower retainer rings 74 are fixed to the shaft 20 and hold the ring 73 against axial movement with respect to the shaft 20, but it is freely rotatable. As can be seen most clearly in FIG. 5, the ring 73 is provided with six equally circumferentially spaced, circularly concave recesses 75, and during working these are in normal positions wherein they face the drill rods 11 with substantial clearance so that the rods 11 can be moved freely axially upwardly and downwardly without interference by the ring 73. There are outwardly extending lobes 76 between each pair of recesses 75, however, and when the ring 73 is rotated approximately 60° in either direction the lobes 76 will be moved to lock positions where they are immediately forward of and face the shoulders 72, thus limiting forward movement of all of the rods 11. Movement of the ring 73 between its normal or working position shown in full lines in FIG. 5 and the lock position shown in broken lines is accomplished from the ground by means of a small vertical actuating shaft 77 that is rotatably journalled in one or more bearings 78 fixed to the shaft 20. At the upper end of the shaft 77 there is a radially outwardly extending, bifurcated operating arm 79 that is adjacent the bottom surface of the ring 73. A pin 80 is fixed to and extends downwardly from the bottom of the ring 73 and is radially movably received between the parts of the arm 79. The arm 79 is rotatable with the shaft 77 between the positions shown in FIG. 5, movement between these positions causing the ring 73 to be rotated between its normal and lock positions.

Rotation of the shaft 77 is affected by means of an actuating arm 81 that is disposed horizontally below the plate 32 and that is fixed at its inner end to a portion of the shaft 77 that extends pivotably through the plate 32. Intermediate its ends, the arm 81 is provided with a downwardly extending handle 82 for manual operation, and at its outer end there is a locking hole 83. When the machine is working, the arm 81 is in the normal position shown in full lines in FIG. 4, and it is held in this position by a spring clip 84 fixed to the underside of the plate 32. One side of the inner end of the arm 81 has a circular arcuate cutout 85 that comes against the shaft 20 to limit movement of the arm 81 in a clockwise direction as seen in FIG. 4.

When the operator desires to lock the rods 11 in place, he grasps the handle 82 and pivots it counterclockwise to the lock position shown in broken lines in FIG. 4, this pivotal movement resulting in corresponding rotation of the shaft 77 and pivotal movement of the arm 79 to move the ring 73 to lock position. In lock position, the hold 83 is in alignment with one of the index holes 34, and a pin 86 is removably inserted through the aligned holes to hold the arm 81 in its lock position; a cotter pin or other means is preferably used to keep the pin 86 from falling out during travel.

The preferred embodiment that has been shown and described is highly effective and yet exceedingly simple and inexpensive. One particular feature is the use of the upper support plate 22 as a support means for the drill rods, a means to prevent them from being removed radially until they are raised, and a wrench means for both attachment and breakout, using flats normally found on the top of drill rods. Another important feature is the locking mechanism which effectively locks all of the drill rod sections in place during travel. Still another important feature is the provision of the indicating means so that the operator can easily determine the vertical and rotational orientation of a rod from his level.

While the embodiment shown and described is preferred, it will be obvious that various modifications might be made without departure from the spirit of the invention. As previously indicated, it is not necessary that the invention be used only in a swinging carousel-type rack, and it might be used with a variety of machines. It would also be possible to put the wrenching upper plate 22 at the bottom of the rack and use a simple plate at the top provided with keyhole openings to cooperate with reduced necks to allow insertion and removal of the rod sections. This would, however, necessitate provision of additional flats at the bottom of the rod and is not as advantageous as the preferred embodiment where the existing flats on the top are used.

Figure 12:
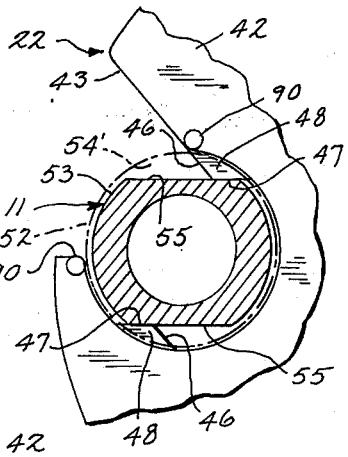
FIG. 12 is a view similar to FIG. 9 but showing an alternative construction.

A number of variations might be made in the upper plate 22. It should be noted, for example, that the surfaces 46 are not radial. This is simply the result of the locations of the head 4 and swing shaft 12 in the particular machine shown; the surfaces 46 are on lines that are generally tangential to the arc of movement of the rack 10 as it swings in and out, and in other machines the lines might be at different angles. It is not strictly necessary to cut away the portions of the plate 42 within the collars 44 to define the second set of straight sides 47; the sides 46 could extend through the entire circumscribed area to define a straight sided cutout with opposite ledges, but while this would hold a rod against rotation in either direction it would not give the desired breakout impact. The cylindrical collars 44, while preferred, are also not necessary as such; it is necessary only that there be retainer means on the base plate defining a throat aligned with the cutout opening and that is smaller than the holding portion of the rod and at least as large as the reduced portion below it. An alternative form of retainer means is shown in FIG. 12 where the construction is the same as that shown in the other views (the same reference numerals being used), except that the collar 44 has been replaced by two posts 90 suitably fixed to the upper surface of the plate 42 and extending vertically to the same level as the upper surface of the collar 44. The posts 90 are at the same points as the ends of the collar 44 and define between them across the cutout opening a throat the same width as the throat 45. As a result, the rod 11 cannot be removed laterally when the portion 52 is vertically aligned with the posts 90, but can be removed when it is raised as previously described. The same effect could be provided by superimposing another plate on the plate 42 and cutting it out to provide spaces like those defined by the collars 44 and similarly shaped and sized throats.

Changes might also be made in the rods 11. The portion 53 need not, for example, be of reduced overall diameter and the flats 55 could simply be cut across a section of normal diameter, which would still provide shoulders like the shoulders 54'; this may be preferable to simplify manufacture and to provide larger flat surfaces. It is also not strictly necessary to have the necks 56. It is necessary only that there be a reduced portion below the full diameter holding portion of the rod that can be moved outwardly through the throat and cutout openings and the portion 53 is itself a reduced portion since the distance between the flats 55 is less than the outer diameter of the rod 11 and it could serve as both the reduced portion and the flatted portion, even to the point of defining lock shoulders; this would be true even if the portion 53 were not of reduced overall diameter. Using only the portion 53 would, however, require quite exact alignment for insertion and removal and this could be a problem, particularly since the rod can rotate to some extent while it is in the rack. Having the neck 56 insures easy lateral insertion and removal regardless of the rod's rotational position. The indicating means in the preferred embodiment are located so they can be easily seen by the operator but equivalent means and locations may be suitable for other machines.

The lock means could of course be used with other carousel-type racks, so long as there are forwardly facing shoulders on the drill rods.

In view of the noted and many other possible modifications and variations, it is not intended that the invention be limited by the showing or description herein, or in any other manner, except insofar as may specifically be required.

We claim:

1. In a drill rod handling device for moving a drill rod into and out of alignment with a rotary drive head to be connected thereto and disconnected therefrom in response to rotation of the head, wherein the drill rod is of the type that is cylindrical and has a holding portion of normal diameter, an axially extending reduced portion below the holding portion, and a flatted portion immediately below the holding portion that defines opposite parallel flats spaced apart a distance less than the outer diameter of the rod, a support plate comprising: a base plate having a cutout defining an outwardly facing opening at least as large as the reduced portion of the rod and at least one set of opposite, parallel straight side portions to receive the flats therebetween and hold the rod against rotation; and retainer means fixed to the upper surface of the base plate and defining an outwardly facing throat that is at least as large as the reduced portion of the rod and in alignment with the cutout opening, the throat being smaller than the holding portion of the rod so that the rod is laterally removable from the support plate through the throat and cutout opening only when it is raised to a level where the holding portion is above the retainer means and the reduced portion is vertically aligned with the support plate.

2. An arrangement according to claim 1 wherein: said support plate is an upper plate; and there is a lower support plate vertically spaced from and parallel and fixedly aligned with respect to the upper support plate, said lower support plate comprising a floor plate with an upwardly opening cylindrical socket on its upper surface in alignment with the collar and cutout, the lower end of the drill rod being loosely received in the socket when the drill rod is in place and moving to a position above the socket when the drill rod has been raised to the level where it can be removed from the upper support plate.

3. In a drill rod handling device for moving a drill rod into and out of alignment with a rotary drive head to be connected thereto and disconnected therefrom in response to rotation of the head, wherein the drill rod is of the type that is cylindrical and has a holding portion of normal diameter, an axially extending reduced portion below the holding portion, and a flatted portion immediately below the holding portion that defines opposite parallel flats spaced apart a distance less than the outer diameter of the rod and opposite horizontal shoulders overhanging respective flats, a support plate comprising: a base plate having a cutout defining an outwardly facing opening at least as large as the reduced portion of the rod and at least one set of opposite, parallel straight side portions to receive the flats therebetween and hold the rod against rotation; and retainer means fixed to the upper surface of the base plate and defining an outwardly facing throat that is at least as large as the reduced portion of the rod and in alignment with the cutout opening, the base plate having an area extending outwardly from the straight side portions to define opposite ledges to supportingly receive the shoulders, the throat being smaller than the holding portion of the rod so that the rod is laterally removable from the support plate through the throat and cutout opening only when it is raised to a level where the holding portion is above the retainer means and the reduced portion is vertically aligned with the support plate.

4. An arrangement according to claim 3 wherein: said support plate is an upper plate; and there is a lower support plate vertically spaced from and parallel and fixedly aligned with respect to the upper support plate, said lower support plate comprising a floor plate with an upwardly opening cylindrical socket on its upper surface in alignment with the collar and cutout, the lower end of the drill rod being loosely received in the socket and being above the floor plate when the drill rod is being supported on the upper plate and moving to a position above the socket when the drill rod has been raised to the level where it can be removed from the upper support plate.

5. An arrangement according to claim 3 wherein: the ledges are cut away to define a second set of parallel straight side portions that are spaced apart a distance substantially equal to the spacing between said one set, said second set of straight portions being disposed at an angle to and intersecting respective members of said one set, said flatted portion of the rod being rotatable to a substantial extent within the cutout between a first position in which the flats engage said one set of straight side portions to prevent further rotation in one direction and a second position in which said flats engage said second set of straight side portions to prevent further rotation in the other direction, the remaining parts of the ledges defining opposite lugs that supportingly engage the shoulders regardless of the rotational position of the rod within its allowed range of rotational movement.

6. An arrangement according to claim 5 wherein: the reduced portion is a neck immediately below the flatted portion that is cylindrical and has an outer diameter less than the distance between the flats.

7. An arrangement according to claim 6 wherein: said support plate is an upper plate; and there is a lower support plate vertically spaced from and parallel and fixedly aligned with respect to the upper support plate, said lower support plate comprising a floor plate with an upwardly opening cylindrical socket on its upper surface in alignment with the collar and cutout, the lower end of the drill rod being loosely received in the socket and being above the floor plate when the drill rod is being supported on the upper plate and moving to a position above the socket when the drill rod has been raised to the level where it can be removed from the upper support plate.

8. An arrangement according to claim 7 wherein: the lower end of the rod has at least one visible indicator vertically aligned with at least one flat; and the socket has at least one visible indicator vertically aligned with at least one of the members of the set of straight side portions that engages the flats when the drill rod is being connected to the drive head.

9. An arrangement according to claim 7 wherein: the drive head and upper end of the drill rod have axially extending threaded portions that are connectable and disconnectable, such actions resulting in relative axial movement of the head and rod; and the socket is provided with two vertically spaced indicating holes through its wall, one of said holes being at a level corresponding to the level of the lower end of the rod when the lower ends of the flats are in alignment with the straight side portions, and the other hole being at a level corresponding to the level of the lower end of the rod when it is supported by the upper support plate.

10. An arrangement according to claim 9 wherein: the lower end of the rod has at least one visible indicator vertically aligned with at least one flat; and the indicating holes in the socket are vertically aligned with one of the members of the set of straight side portions that engages the flats during a tightening action.

11. In a drill rod handling device of the carousel type for indexing any of a plurality of drill rods and moving the same into and out of alignment with a rotary drive head for connection thereto and disconnection therefrom in response to rotation of the drive head, said device including aligned, vertically spaced upper and lower support plates that are simultaneously rotatable to any of an equal plurality of indexed positions and are provided, respectively, with an equal plurality of upper and lower drill rod holding means at locations corresponding to said position, each drill rod being cylindrical with a holding portion of normal diameter, an axially extending reduced portion below the holding portion, and a flatted portion immediately below the holding portion that defines opposite parallel flats spaced apart a distance less than the outer diameter of the rod and opposite horizontal shoulders overhanging respective flats, the improvement wherein one of the support plates and its associated holding means comprises: a base plate having an equal plurality of cutouts, each defining an outwardly facing opening at least as large as the reduced portion of the rod and at least one set of opposite, parallel straight side portions to receive the flats therebetween and hold the rod against rotation; and an equal plurality of retainer means, one for each cutout, fixed to the upper surface of the base plate, each retainer means defining an outwardly facing throat that is at least as large as the reduced portion of the rod and in alignment with the cutout opening, the base plate having, for each cutout, an area extending outwardly from the straight side portions to define opposite ledges to supportingly receive the shoulders, the throat being smaller than the holding portion of the rod so that the rod is laterally removable from the support plate through the throat and cutout opening only when it is raised to a level where the holding portion is above the retainer means and the reduced portion is vertically aligned with the said one support plate.

12. An arrangement according to claim 11 wherein: the ledges of each cutout are cut away to define a second set of parallel straight side portions that are spaced apart a distance substantially equal to the spacing between said one set, said second set of straight portions being disposed at an angle to and intersecting respective members of said one set, said flatted portion of the rod being rotatable to a substantial extent within the cutout between a first position in which the flats engage said one set of straight side portions to prevent further rotation in one direction and a second position in which said flats engage said second set of straight side portions to prevent further rotation in the other direction, the remaining parts of the ledges defining opposite lugs that supportingly engage the shoulders regardless of the rotational position of the rod within its allowed range of rotational movement.

13. An arrangement according to claim 12 wherein: the reduced portion is a neck immediately below the flatted portion that is cylindrical and has an outer diameter less than the distance between the flats.

14. An arrangement according to claim 13 wherein: said one support plate is the upper plate; and said lower support plate and its retaining means comprises a floor plate with an equal plurality of upwardly opening cylindrical sockets on its upper surface in alignment with respective collars and cutouts, the lower end of each drill rod being loosely received in the associated socket and being above the floor plate when the drill rod is being supported on the upper plate and moving to a position above the socket when the drill rod has been raised to the level where it can be removed from the upper support plate.

15. An arrangement according to claim 14 wherein: the lower end of each rod has at least one visible indicator vertically aligned with at least one of its flats; and each socket has at least one visible indicator vertically aligned with at least one of the members of the associated set of straight side portions that engages the flats when the drill rod is being connected to the drive head.

16. An arrangement according to claim 14 wherein: the drive head and upper end of each drill rod have axially extending threaded portions that are connectable and disconnectable, such actions resulting in relative axial movement of the head and rod; and each socket is provided with two vertically spaced indicating holes through its wall, one of said holes being at a level corresponding to the level of the lower end of the rod when the lower ends of its flats are in alignment with the associated straight side portions, and the other hole being at a level corresponding to the level of the lower end of the rod when it is supported by the upper support plate.

17. An arrangement according to claim 16 wherein: the lower end of each rod has at least one visible indicator vertically aligned with at least one of its flats; and the indicating holes each socket are vertically aligned with one of the members of the associated set of straight side portions that engages the flats during a tightening action.

18. An arrangement according to claim 17 wherein: the device includes a rotatable vertical center shaft to which the upper and lower support plates are fixed; the neck of each rod defines an upwardly facing annular lock shoulder; and there is a lock means selectively operable to prevent upward axial movement of the rods, said lock means comprising a lock ring surrounding the shaft and parallel to the upper and lower support plates, said ring being held against axial movement along the shaft but being rotatable between normal and lock positions, the periphery of said lock ring being shaped to define an equal plurality of recesses that in normal position face respective rods with sufficient clearance to allow axial movement of the rods in either direction, and an equal plurality of outwardly extending lobes between respective pairs of recesses, rotation of the ring to lock position causing the lobes to be brought into positions facing the lock shoulders.

19. In a drill rod handling device of the carousel type comprising a rotatable center shaft and aligned upper and lower support plates fixed to and rotatable with the shaft, means on the support plates for holding the upper and lower ends of a plurality of circumferentially arranged drill rods, said means allowing at least some axial movement of the rods in a direction away from the lower support plate, lock means to prevent said axial movement, said lock means comprising: reduced portions in the drill rods defining lock shoulders facing the direction of said axial movement; and a lock ring surrounding the shaft and parallel to the support plates, the lock ring being held against axial movement on the shaft but being rotatable between normal and lock positions, the periphery of said lock ring being shaped to define an equal plurality of recesses that in normal position face respective rods with sufficient clearance to allow axial movement of the rods in either direction, and an equal plurality of outwardly extending lobes between respective pairs of recesses, rotation of the ring to lock position causing the lobes to be brought into positions facing the lock shoulders.

20. An arrangement according to claim 19 wherein: there is an actuating shaft for rotating the lock ring; and there is an actuating arm pivotably mounted on the lower support plate for rotating the actuating shaft; and there is means on the lower support plate to releasably hold the actuating arm in positions corresponding to normal and lock positions of the lock ring.

* * * * *